US009869496B2

(12) United States Patent
Facemyer

(10) Patent No.: US 9,869,496 B2
(45) Date of Patent: Jan. 16, 2018

(54) LIQUID CHILLER SYSTEM

(71) Applicant: Luke T. Facemyer, St. Johns, FL (US)

(72) Inventor: Luke T. Facemyer, St. Johns, FL (US)

(73) Assignee: STELLAR REFRIGERATION CONTRACTING, INC., Jacksonville, FL (US)

( * ) Notice: Subject to any disclaimer, the term of this patent is extended or adjusted under 35 U.S.C. 154(b) by 63 days.

(21) Appl. No.: 14/837,128

(22) Filed: Aug. 27, 2015

(65) Prior Publication Data

US 2017/0059217 A1 Mar. 2, 2017

(51) Int. Cl.
*F25B 39/02* (2006.01)
*F25B 39/04* (2006.01)

(52) U.S. Cl.
CPC ..... *F25B 39/04* (2013.01); *F25B 39/02* (2013.01); *F25B 2339/024* (2013.01); *F25B 2339/044* (2013.01); *F25B 2500/01* (2013.01)

(58) Field of Classification Search
CPC ..... F25B 39/028; F25B 39/02
USPC ..... 62/471.476, 504
See application file for complete search history.

(56) References Cited

U.S. PATENT DOCUMENTS 6,519,967 B1 2/2003 Mosemann et al.
2002/0007639 A1* 1/2002 Carey ..... F25B 31/004 62/84
2002/0162352 A1* 11/2002 Ring ..... F25B 31/004 62/471

* cited by examiner

*Primary Examiner* — Melvin Jones
(74) *Attorney, Agent, or Firm* — Rogers Towers PA; Joseph P. Kincart

(57) ABSTRACT

A liquid chiller system utilizing a refrigerant capable of possessing a liquid state and a gas/vapor state, the refrigerant being cycled through a closed loop assembly of a compressor, an eccentric condenser and an eccentric evaporator. The eccentric compressor has a lower integrated reservoir and the eccentric evaporator has an upper dedicated reservoir such that separate, dedicated separator or receiver vessels are not required. The eccentric condenser is positioned above the eccentric evaporator such that liquid refrigerant flows by gravity from the eccentric condenser to the eccentric evaporator.

13 Claims, 1 Drawing Sheet

LIQUID CHILLER SYSTEM

BACKGROUND OF THE INVENTION

The invention relates in general to liquid chiller or refrigeration systems for cooling a liquid processed through the system, the chilled process liquid being utilized for example to maintain a storage room at a temperature well below ambient. The invention relates to such systems that utilize an evaporator, a compressor, a condenser and a flow control mechanism.

Refrigeration is the lowering of the temperature of air or liquid within an enclosed space (kitchen refrigerators, store coolers, freezers, storage rooms, living quarters, etc.) by removing heat from the space and transferring it elsewhere. A typical refrigeration or chiller system utilizes a compressible refrigerant, such as for example ammonia, circulated through a closed loop assembly of interconnected devices. Refrigerant stored in a separator vessel in the gaseous or saturated vapor phase is delivered to a compressor for compression, which raises the temperature of the refrigerant. The compressed refrigerant is then passed to a condenser. A coolant liquid, such as for example water, is passed through plates, coils or tubes within the condenser to lower the temperature of the refrigerant gas such that it is condensed into a liquid phase, the heat from the refrigerant being transferred to and removed by the coolant liquid. The condensed liquid refrigerant is stored in a receiver vessel and then delivered by a flow control mechanism through an expansion valve within an evaporator, where it undergoes an abrupt reduction in pressure, resulting in evaporation of part of the refrigerant to further lower the temperature of the refrigerant. The process liquid to be chilled, such as for example glycol, is passed through plate, coils or tubes within the evaporator such that heat from the process liquid transfers to the liquid/vapor refrigerant, causing evaporation of the liquid phase of the refrigerant and lowering the temperature of the process liquid, which is then delivered back to provide the desired cooling effect. The refrigerant vapor is passed from the evaporator into the separator vessel and the cycle is repeated.

It is an object of this invention to provide an improved chiller or refrigeration system that eliminates the need for separator vessels and receiver vessels, which allows for a reduction in the quantity of refrigerant required, and which results in a system occupying a smaller footprint and volume.

SUMMARY OF THE INVENTION

The invention in various embodiments is a refrigeration or liquid chiller system of the evaporator/compressor/condenser type. The condenser is an eccentric condenser wherein the plates, coils or tubes receiving the coolant liquid are positioned in the upper half of the condenser body such that the lower half of the condenser body acts as a reservoir for the condensed liquid refrigerant, and further wherein the internal volume of the condenser is sufficiently large so as to obviate the need for providing a separate, dedicated receiver vessel to retain the liquid refrigerant in line between the condenser and the evaporator. The evaporator is likewise an eccentric evaporator wherein the plates, coils or tubes receiving the process liquid being cooled are located in the lower half of the evaporator body such that the upper half of the evaporator body acts as a reservoir for the vaporized refrigerant, and further wherein the internal volume of the evaporator is sufficiently large so as to obviate the need for providing a separate, dedicated separator vessel to retain the vaporized refrigerant in line between the evaporator and the compressor. Preferably, the condenser is physically positioned above the evaporator such that the liquid refrigerant may be gravity fed to the evaporator.

In alternative language, the invention is a liquid chiller system comprising a condenser, an evaporator, a compressor and a refrigerant, said refrigerant being a liquid refrigerant and a gas refrigerant at different stages of the chilling operation: said condenser being an eccentric condenser comprising an oversized shell with coolant liquid conduits disposed in the upper half of said condenser oversized shell such the lower half of said condenser oversized shell defines a liquid refrigerant reservoir of sufficient capacity to obviate the need for a separate, distinct reservoir vessel; said evaporator being an eccentric evaporator comprising an oversized shell with process liquid conduits disposed in the lower half of said evaporator oversized shell such that the upper half of said evaporator oversized shell defines a gas refrigerant reservoir of sufficient capacity to obviate the need for a separate, distinct separator vessel; and possibly further wherein said eccentric condenser is positioned higher than said eccentric evaporator such that liquid refrigerant is gravity fed from said eccentric condenser to said eccentric evaporator; further comprising a flow control device disposed between said eccentric condenser and said eccentric evaporator; wherein the capacity of said evaporator oversized shell is sufficient to retain all of the liquid refrigerant from said eccentric condenser without passing the liquid refrigerant to said compressor; wherein said liquid refrigerant reservoir is of sufficient capacity to retain at least approximately 10 percent of the liquid refrigerant within the liquid chiller system and wherein said gas refrigerant reservoir is of sufficient capacity to retain at least approximately 65 percent of the liquid refrigerant within the liquid chiller system; and/or wherein the liquid refrigerant is delivered from said eccentric condenser to said eccentric evaporator without passage through a separate reservoir vessel, and wherein the gas refrigerant is delivered from said eccentric condenser to said compressor without passage through a separate separator vessel.

Likewise, the invention may be described as a liquid chiller system comprising a condenser, an evaporator, a compressor and a refrigerant, said refrigerant being a liquid refrigerant and a gas refrigerant at different stages of the chilling operation: said condenser being an eccentric condenser comprising an oversized shell with coolant liquid conduits disposed in the upper half of said condenser oversized shell such the lower half of said condenser oversized shell defines a liquid refrigerant reservoir; said evaporator being an eccentric evaporator comprising an oversized shell with process liquid conduits disposed in the lower half of said evaporator oversized shell such that the upper half of said evaporator oversized shell defines a gas refrigerant reservoir, and wherein the liquid refrigerant is delivered from said eccentric condenser to said eccentric evaporator without passage through a separate reservoir vessel, and wherein the gas refrigerant is delivered from said eccentric condenser to said compressor without passage through a separate separator vessel, and optionally furthermore wherein the capacity of said evaporator oversized shell is sufficient to retain all of the liquid refrigerant from said eccentric condenser without passing the liquid refrigerant to said compressor; wherein said eccentric condenser is positioned higher than said eccentric evaporator such that liquid refrigerant is gravity fed from said eccentric condenser to said eccentric evaporator; further comprising a flow control device disposed between said eccentric condenser and said eccentric evaporator; and/or wherein said liquid refrigerant reservoir is of sufficient capacity to retain at least approximately 10 percent of the liquid refrigerant within the liquid chiller system and wherein said gas refrigerant reservoir is of sufficient capacity to retain at least approximately 65 percent of the liquid refrigerant within the liquid chiller system.

Still otherwise, the invention is a liquid chiller system comprising a condenser, an evaporator, a compressor and a refrigerant, said refrigerant being a liquid refrigerant and a gas refrigerant at different stages of the chilling operation: said condenser being an eccentric condenser comprising an oversized shell with coolant liquid conduits disposed in the upper half of said condenser oversized shell such the lower half of said condenser oversized shell defines a liquid refrigerant reservoir of sufficient capacity to retain at least approximately 10 percent of the liquid refrigerant within the liquid chiller system; and said evaporator being an eccentric evaporator comprising an oversized shell with process liquid conduits disposed in the lower half of said evaporator oversized shell such that the upper half of said evaporator oversized shell defines a gas refrigerant reservoir of sufficient capacity to retain at least approximately 65 percent of the liquid refrigerant within the liquid chiller system, and optionally wherein said eccentric condenser is positioned higher than said eccentric evaporator such that liquid refrigerant is gravity fed from said eccentric condenser to said eccentric evaporator; further comprising a flow control device disposed between said eccentric condenser and said eccentric evaporator; wherein said liquid refrigerant reservoir and said gas refrigerant reservoir are of sufficient capacity to obviate the need for a separate, distinct reservoir vessel and separate, distinct separator vessel; and/or wherein the liquid refrigerant is delivered from said eccentric condenser to said eccentric evaporator without passage through a separate reservoir vessel, and wherein the gas refrigerant is delivered from said eccentric condenser to said compressor without passage through a separate separator vessel.

DETAILED DESCRIPTION OF THE INVENTION

With reference to the drawings, embodiments of the invention will now be described in detail. In general, the invention is a refrigeration or liquid chiller system utilizing a refrigerant capable of possessing a liquid state and a gas/vapor state, the refrigerant being cycled through a closed loop assembly comprising a compressor, a condenser and an evaporator. Suitable known refrigerants include, for example, ammonia, carbon dioxide or hydrocarbons such as propane. In order to chill a process liquid, which then may be used for example to lower the temperature of an enclosed space or other gases or liquids, the refrigerant is compressed while in the vapor state and delivered to the condenser. A liquid coolant is passed through plates, coils or tubes in the condenser to lower the temperature of the refrigerant to convert the refrigerant from a compressed gas into a liquid, and the liquid refrigerant is then delivered into the evaporator and allowed to partially evaporate to a combined liquid/vapor state. The process liquid to be chilled is passed through plates, coils or tubes in the evaporator such that heat is transferred from the process liquid into the refrigerant, thereby evaporating the liquid phase of the refrigerant. The gas refrigerant is then delivered back to the compressor, and the cycle is repeated. The system is sized and structured so as not to require separate, dedicated separator (often referred to as a surge drum) or receiver vessels.

Figure 1:
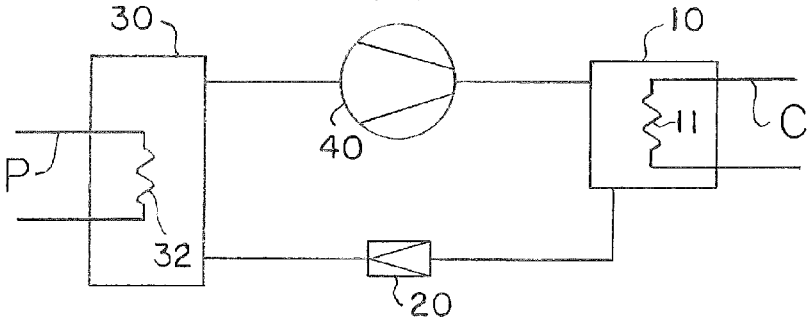
FIG. 1 is a schematic representation of an embodiment of the chiller system.

FIG. 1 shows a representative schematic of the chiller system. Compressor 40, such as for example a screw or reciprocating type compressor, of suitable size and power to compress the chosen refrigerant, is operatively positioned in line and in fluid communication between the evaporator 30 and the condenser 10. The system may utilize various known refrigerants suitable for the purpose, such as for example ammonia, $CO_2$ or hydrocarbons, which are capable of being compressed while in the vapor or gas phase and condensed into the liquid phase within suitable temperature and pressure ranges, for application in various commercial or residential refrigeration systems. The compressor 40 receives refrigerant in the gas phase from the evaporator 30, compresses the gas refrigerant, and delivers the compressed gas refrigerant to the condenser 10.

Figure 2:
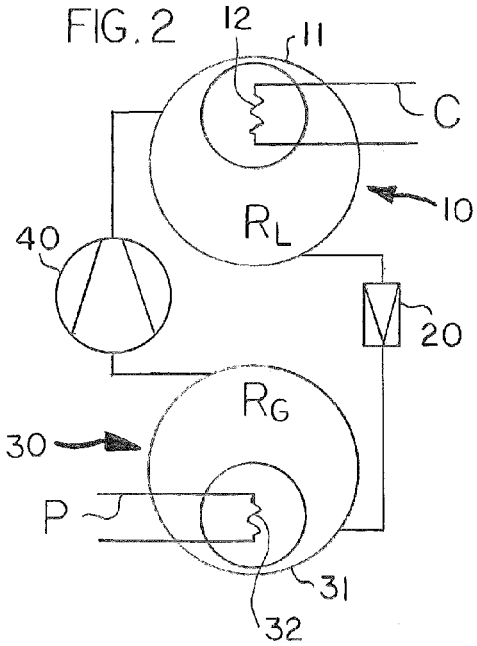
FIG. 2 is an alternative schematic of an embodiment of the chiller system, illustrating the eccentric evaporator and eccentric chiller.

The condenser 10 is an eccentric condenser, such as for example a plate and shell type condenser wherein the shell is oversized to increase the internal volume. The term "oversized" is used herein to define a shell having a greater capacity than required to perform the condensing operation. In the embodiment represented in FIG. 2, it is seen that the portion of the coolant liquid flow circuit C located internally within the condenser 10, which portion consists of plates, coils or tubes that are conduits 12 for the coolant liquid into, through and from the condenser shell or body 11, are positioned in the upper half of the condenser shell 11. The conduits 12 segregate the coolant liquid from the refrigerant within the condenser 10 such that heat is transferred from the compressed gas refrigerant into the coolant liquid. The gas refrigerant thereupon condenses into its liquid phase and collects in the lower half of the condenser 10, the lower half of the condenser defining a sump or reservoir $R_L$. The internal volume of the oversized condenser shell 11 is sized so as to be sufficient to retain the minimum volume of liquid refrigerant necessary for continuous operation of the chiller system while simultaneously leaving room to receive the gas refrigerant from the compressor 40. In this manner, a separate receiver vessel is not required downstream of the condenser 10 for storage of the liquid refrigerant after it has been condensed. The liquid refrigerant is then delivered from the condenser 10, most preferably by gravity, to the evaporator 30, the condenser 10 being positioned at a higher elevation than the evaporator 30, as represented in FIG. 2.

A flow control mechanism 20, comprising for example a float valve or any other suitable mechanical valve, is disposed in line between the condenser 10 and the evaporator 30 to control the flow of liquid refrigerant.

The evaporator 30 is an eccentric evaporator, such as for example a plate and shell type evaporator wherein the shell 31 is oversized to increase the internal volume. The term "oversized" is used herein to define a shell having a greater capacity than required to perform the evaporating operation. The liquid refrigerant is delivered from the condenser 10 through an expansion valve such that a portion of the refrigerant evaporates and creates a liquid/vapor mixture. In the embodiment represented in FIG. 2, it is seen that the portion of the process liquid flow circuit P located internally within the evaporator 30, which portion consists of plates, coils or tubes that are conduits 32 for the process liquid into, through and from the evaporator shell or body 31, are positioned in the lower half of the evaporator shell 31. The conduits 32 segregate the process liquid from the refrigerant within the evaporator 30 such that heat is transferred from the process liquid into the liquid refrigerant, thereby lowering the temperature of the process liquid and converting the refrigerant from the liquid phase to the gas phase, which collects in the upper half of the evaporator 30, the upper half of the condenser defining a reservoir $R_G$. The internal volume of the oversized evaporator shell 31 is sized so as to be sufficient, if necessary, to retain the entire volume of liquid refrigerant from the condenser 10 below a high level cut-out point to insure that no liquid refrigerant passes to the compressor 40, i.e., the evaporator shell 31 can handle a full surge volume of liquid refrigerant without allowing any liquid refrigerant to enter the conduits transporting the gas refrigerant to the compressor 40. In this manner, a separate, dedicated separator vessel downstream from the evaporator 30 is not required for storage of the gas refrigerant after it has been evaporated. The gas refrigerant is then delivered from the evaporator 30 directly to the compressor 20 to complete the cycle.

With this structure the eccentric condenser 10 can be defined as having an integrated receiver vessel and the eccentric evaporator 30 can be defined as having an integrated separator vessel. Preferably, the capacity of the oversize shell 31 of the eccentric evaporator 30 is at least approximately 65% of the total volume of liquid refrigerant in the system and the capacity of the oversize shell of the eccentric condenser 10 is a least 10% of the total volume of liquid refrigerant in the system, the remaining volume of liquid refrigerant being retained in the condenser or transport piping or conduits.

In operation the gas refrigerant is compressed by the compressor 40 and delivered to the eccentric condenser 10. A liquid coolant in the coolant liquid flow circuit C is passed through the plates, coils or tubes of conduits 12 in the eccentric condenser 10 to lower the temperature of the gas refrigerant to convert the refrigerant from a compressed gas into a liquid, which is retained in the liquid reservoir $R_L$ within the eccentric condenser 10. The liquid refrigerant is then delivered to the eccentric evaporator 30 without passage through or storage in a separate and distinct reservoir vessel. The liquid refrigerant is allowed to partially evaporate into a combined liquid/vapor state. The process liquid resident in the process liquid flow circuit P, i.e., the liquid to be chilled, is passed through the plates, coils or tubes of conduits 32 in the eccentric evaporator 30 such that heat is transferred from the process liquid into the liquid refrigerant, thereby evaporating the liquid phase of the refrigerant and cooling the process liquid. The gas refrigerant is retained in the gas reservoir $R_G$ within the eccentric evaporator 30, then delivered from the eccentric evaporator 30 back to the compressor 40 without passing through or storage in a separate and distinct separator vessel, and the cycle is repeated.

As a representative example not intending to limit the scope of the invention, the liquid chiller system may utilize ammonia as the refrigerant and glycol as the process liquid, a 529 horsepower screw compressor, an eccentric plate and shell condenser such as a Vahterus model PSHE 7/6HH-406, an eccentric evaporator such as a Vahterus model PSHE 8/6HH-438. Cooling water is provided at 82 degrees F. Such a system will cool 2,230 gpm of glycol from 33 degrees F. to 28 degrees F. while utilizing only 485 pounds of ammonia as liquid refrigerant for 446 TR (1.08 pounds/TR). During operation approximately 39 pounds (about 8% of the total volume) of the liquid refrigerant will be present in the condenser and approximately 281 pounds (about 58% of the total volume), with the remaining approximately 165 pounds (about 34% of the total volume) distributed elsewhere in the system. Such a system produces a cooling efficiency equal to or better than typical systems utilizing greater amounts of refrigerant and additional system operational components.

It is contemplated that equivalents and substitutions for elements and structures set forth, described and illustrated above may be obvious to those of ordinary skill in the art, and therefore the true scope and definition of the invention is to be as set forth in the following claims.

I claim:

1. A liquid chiller system comprising;

an eccentric condenser unit comprising a cooling conduit in an upper portion to lower a temperature of a gas refrigerant passing through the cooling conduit thereby converting a gas refrigerant to a liquid refrigerant and an integrated liquid reservoir located within the eccentric condenser unit below the cooling conduit and containing at least 10% of the liquid refrigerant with the liquid chiller system;

transport piping conveying the liquid refrigerant a process liquid flow circuit containing a process liquid;

an eccentric evaporator comprising process liquid conduits in a lower half of the eccentric evaporator said eccentric evaporator receiving the liquid refrigerant from the eccentric condenser via the transport piping;

an expansion valve within the eccentric evaporator partially evaporating the liquid refrigerant into the gas refrigerant within the eccentric evaporator with absorption of heat from the process liquid in the eccentric evaporator thereby cooling the process liquid;

an integrated gas refrigerant reservoir located within the eccentric evaporator in an upper portion of the eccentric evaporator and containing at least 65% of the gas refrigerant;

a compressor compressing some of the gas refrigerant and passing the compressed gas refrigerant to the eccentric condenser where the compressed gas refrigerant is converted from the gas refrigerant into the liquid refrigerant:

wherein a integrated liquid refrigerant reservoir comprises a sufficient capacity to obviate a need for a separate, distinct reservoir vessel; and said integrated gas refrigerant reservoir comprises sufficient capacity to obviate the need for a separate, distinct separator vessel as the gas refrigerant is passed from the eccentric evaporator to the compressor.

2. The system of claim 1, wherein said eccentric condenser is positioned at a higher elevation than said eccentric evaporator such that liquid refrigerant is gravity fed from said eccentric condenser to said eccentric evaporator.

3. The system of claim 2, further comprising a flow control device disposed between said eccentric condenser and said eccentric evaporator.

4. The system of claim 3, wherein a capacity of said liquid reservoir is sufficient to retain all of the liquid refrigerant from said eccentric condenser without passing the liquid refrigerant to said compressor.

5. The system of claim 4, further comprising a flow control device disposed between said eccentric condenser and said eccentric evaporator.

6. The system of claim 1, wherein the liquid refrigerant is delivered from said eccentric condenser to said eccentric evaporator without passage through a separate reservoir vessel, and wherein the gas refrigerant is delivered from said eccentric condenser to said compressor without passage through a separate separator vessel.

7. The chiller system of claim 3, wherein the cooling conduit comprises a plate.

8. The chiller system of claim 3, wherein the cooling conduit comprises a coil.

9. The chiller system of claim 3, wherein the cooling conduit comprises a tube.

10. The chiller system of claim 3, wherein the process liquid flow circuit comprises a plate.

11. The chiller system of claim 3, wherein the process liquid flow circuit comprises a coil.

12. The chiller system of claim 3, wherein the process liquid flow circuit comprises a tube.

13. The chiller system of claim 3, wherein the liquid refrigerant comprises ammonia and the process comprises glycol and the chiller system will more than 2,200 gallons per minute of the glycol process liquid from 33 degrees Fahrenheit to 28 degrees Fahrenheit while utilizing less than 500 pounds of ammonia as the liquid refrigerant such that during operation less than 40 pounds of the liquid refrigerant is present in the condenser.

* * * * *